US006739305B2

(12) United States Patent
Takahara et al.

(10) Patent No.: US 6,739,305 B2
(45) Date of Patent: May 25, 2004

(54) OIL PUMP FOR INTERNAL COMBUSTION ENGINE AND METHOD OF OPERATING THE SAME

(75) Inventors: Toshihiro Takahara, Kariya (JP); Yoshihiko Doi, Kariya (JP)

(73) Assignees: Toyoda Boshoku Corporation, Kariya (JP); Denso Corporation, Kariya (JP)

( * ) Notice: Subject to any disclaimer, the term of this patent is extended or adjusted under 35 U.S.C. 154(b) by 44 days.

(21) Appl. No.: 10/092,505

(22) Filed: Mar. 8, 2002

(65) Prior Publication Data

US 2002/0139345 A1 Oct. 3, 2002

(30) Foreign Application Priority Data

Mar. 27, 2001 (JP) ..... 2001-089803

(51) Int. Cl.[7] ..... F01M 1/00
(52) U.S. Cl. ..... 123/196 R; 123/196 S
(58) Field of Search ..... 123/196 S, 196 R, 123/41.01, 41.05; 184/6.28, 27.2

(56) References Cited

U.S. PATENT DOCUMENTS

| | | | | |
|---|---|---|---|---|
| 4,431,372 A | * | 2/1984 | Dadhich | 184/27.2 |
| 4,629,033 A | * | 12/1986 | Moore et al. | 184/27.2 |
| 5,000,143 A | * | 3/1991 | Brown | 123/196 S |
| 5,036,803 A | * | 8/1991 | Nolting et al. | 123/41.1 |
| 6,349,692 B1 | * | 2/2002 | Reinosa | 123/196 S |
| 6,350,108 B1 | * | 2/2002 | Haupt | 123/196 S |
| 6,523,519 B2 | * | 2/2003 | Iwano et al. | 123/196 R |
| 6,527,074 B1 | * | 3/2003 | Morishita | 184/27.2 |

FOREIGN PATENT DOCUMENTS

| | | |
|---|---|---|
| DE | 973 994 | 8/1960 |
| DE | 29 16 216 A1 | 11/1980 |
| DE | 39 29 078 A1 | 3/1991 |
| EP | 0 591 167 B1 | 10/1998 |
| JP | 53-081842 A | 7/1978 |
| JP | 60-032921 A | 2/1985 |
| JP | 60-032923 A | 2/1985 |
| JP | 10-77817 | 3/1998 |
| JP | 10-077817 A | 3/1998 |
| JP | 11-287316 A | 10/1999 |

* cited by examiner

*Primary Examiner*—Henry C. Yuen
*Assistant Examiner*—Jason Benton
(74) *Attorney, Agent, or Firm*—Oliff & Berridge, PLC

(57) ABSTRACT

An oil pump for an internal combustion engine is provided with an intake port and a discharge port, each formed in a pump housing. The oil pump has a power pump serving as a first main pump and an electric pump serving as a second auxiliary pump, both of which may be contained in a same pump housing. The power pump is rotated by a driving force of a crankshaft, and the electric pump is rotated by the driving force of an electric motor. This makes it possible to reduce the maximum capacity of the power pump serving as the main pump. In a vehicle operating range where the oil discharging pressure generated by the power pump becomes insufficient, the electric pump serving as the auxiliary pump is operated together with the power pump such that appropriate oil discharging pressure or appropriate oil discharging quantity can be achieved. The electric pump may also be allowed to operate for a period of time after shutting off of the engine.

17 Claims, 6 Drawing Sheets

OIL PUMP FOR INTERNAL COMBUSTION ENGINE AND METHOD OF OPERATING THE SAME

INCORPORATION BY REFERENCE

The disclosure of Japanese Patent Application No. 2001-89803 filed on Mar. 27, 2001, including the specification, drawings and abstract are incorporated herein by reference in its entirety.

BACKGROUND OF THE INVENTION

1. Field of Invention

The invention relates to an oil pump used in an internal combustion engine for a vehicle and a method for operating the oil pump.

2. Description of Related Art

Generally a trochoid pump is well known as being employed for lubricating an internal combustion engine (hereinafter simply referred to as an engine) for a vehicle as disclosed in, for example, JP-A-10-77817. The aforementioned trochoid pump has a shaft that is rotated by a driving force of a crankshaft of the engine so as to discharge the oil by quantity proportional to a revolution speed of the engine and to generate a hydraulic pressure. When a discharge pressure of the pump is detected to become equal to or greater than a predetermined pressure value, a relief valve disposed on the discharge port of the pump opens to communicate the discharge port and an intake port. As a result, a portion of the oil discharged from the discharge port is returned to the intake port. This makes it possible to prevent a damage of or oil leakage from an engine lubricating system.

In the above-described oil pump for the engine, a surplus of the oil is returned to a low-pressure side of the lubricating system through a relief valve, thus preventing the damage and oil leakage occurred in the engine lubricating system. The aforementioned mechanism, however, may cause a loss of a mechanical energy that forces a valve element against a biasing force generated by a spring of the relief valve, and a loss of a driving energy that circulates the oil by returning the surplus of the oil pumped up by the oil pump to the low-pressure side of the system. This may reduce a fuel consumption efficiency, resulting in vibration or noise in the engine.

The hydraulic pressure and the oil discharge quantity controlled to required values at a high engine speed may not meet the required hydraulic pressure and the oil discharge quantity at a low speed of the engine, resulting in insufficient hydraulic pressure value and insufficient quantity of the oil. Especially when the vehicle is in an idling state at a high temperature of the engine, the hydraulic pressure of the engine is minimized. Therefore, the hydraulic pressure value and the oil quantity supplied to a bearing, valve system, and other oil lubricating system may become insufficient.

SUMMARY OF THE INVENTION

An object of the invention is to provide an oil pump for an engine and a method of operating the oil pump, which prevents the hydraulic pressure value or an oil discharging quantity from being excessively generated at a middle or a high revolution speed of the engine, and improves driveability and reliability of the engine at a low revolution speed.

Another object of the invention is to provide an oil pump for an engine and a method for operating the oil pump, in which a basic oil discharging pressure is generated by a power pump driven by the driving force of the engine, while controlling the basic oil discharging force using an electric signal.

Another object of the invention is to provide an oil pump for an engine and a method for operating the oil pump, in which a power pump serving as a main pump driven by the driving force generated by the engine and an electric pump serving as an auxiliary pump operated by an electric signal are combined to constitute the oil pump.

In the oil pump according to the invention, a power pump rotated together with the driving shaft of the engine and the electric pump rotated by the electric motor are provided in the same pump housing. This makes it possible to cause any of the pumps to compensate the other that is damaged. This also makes it possible to enhance the power of the oil pump by operating both pumps. The oil pump of the invention can be operated in various ways in accordance with the intended use by controlling distribution of the driving force supplied from two types of driving sources. The basic oil discharging pressure supplied from the power pump can be adjusted or corrected by the discharging pressure generated by the electric pump. As a result, the oil pump can be operated with high efficiency by executing appropriate energy distribution.

As the driving shaft of the engine is generally used as the driving source of the power pump, the resultant discharging pressure and the discharging quantity are adapted to the engine speed. Employment of the electric pump as an auxiliary pump in addition to the power pump as the main pump allows a precision control of the engine that is well adapted to a running state of the engine or the intention of a vehicle operator.

The electric pump serving as the auxiliary pump allows reduction of maximum capacity of the power pump serving as the main pump. Therefore, the electric pump is operated in the vehicle speed range where the oil discharging pressure generated by the power pump becomes insufficient so as to increase the oil discharging pressure and the oil discharging quantity to appropriate values. In the middle speed or high speed range where the oil discharging pressure becomes excessive, the oil discharging pressure or the oil discharging quantity is controlled to a minimum value. While in the low vehicle speed range, sufficient oil discharging pressure or oil discharging quantity can be achieved.

An oil pump for an internal combustion engine according to the invention includes a check valve that is disposed in an oil passage for connecting a discharge port of the power pump to a discharge port of the electric pump such that an oil is allowed to flow only in a direction from the electric pump to the power pump. As the above-described oil pump allows the power pump to be operated alone within the pump housing, the oil pump of the invention is useful as being a combined pump unit including accessories of the oil pump.

In a method of operating the aforementioned oil pump of the invention, a drive circuit for driving the electric pump is actuated when the engine is operated for at least a predetermined period of time, and oil temperature reaches at least about 80° C. As a result, the electric pump is operated forcibly when a period for operating the engine continues for a long period of time, or oil temperature is high. As a result, the oil pump may be prevented from being in a stuck state owing to sludge contained in the oil, thus protecting functions of the oil pump.

In a method of operating the aforementioned oil pump of the invention, the electric pump is operated for a predetermined time period after turning off an ignition switch of the engine. The electric pump is preliminarily operated such that the next re-start of the engine can be smoothly operated.

DETAILED DESCRIPTION OF PREFERRED EMBODIMENTS

Figure 1:
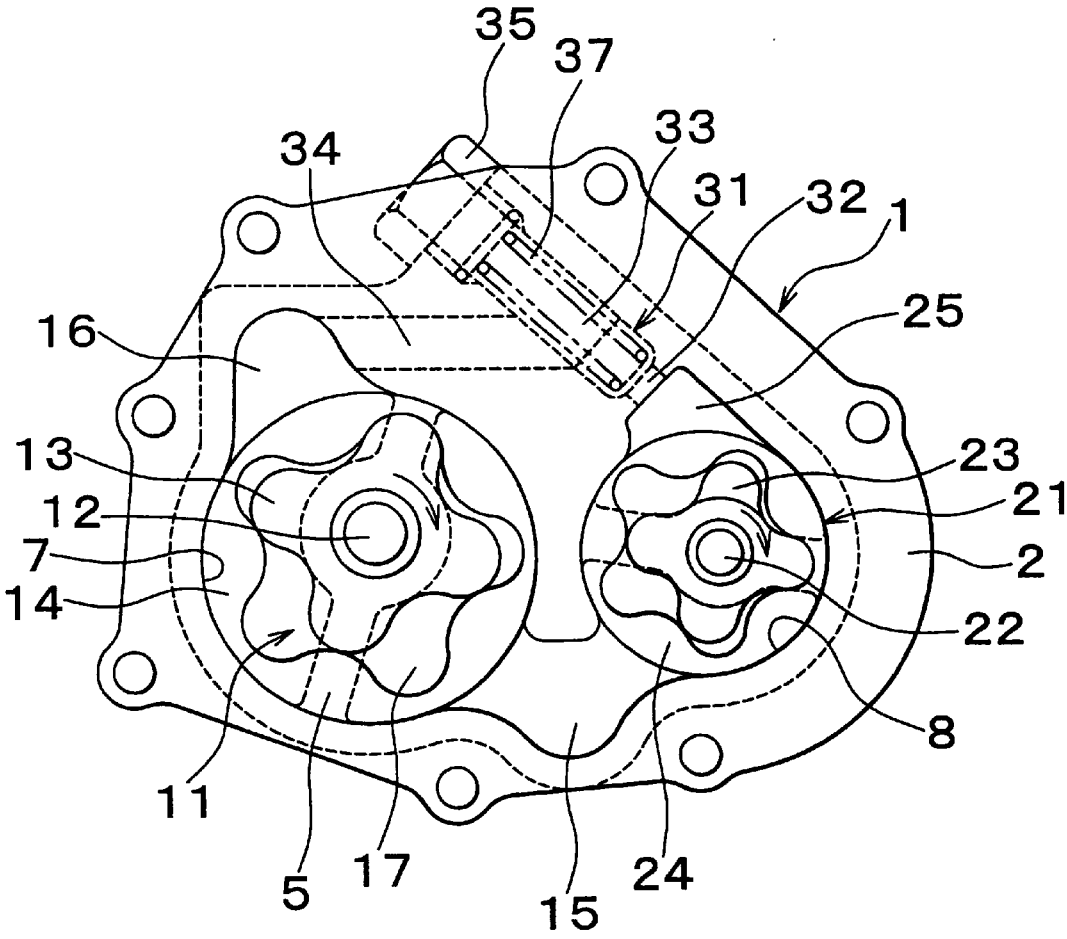
FIG. 1 is a schematic view illustrating an oil pump for an engine according to an embodiment of the invention.

Embodiments of the invention will be described referring to the drawings.

Figure 2:
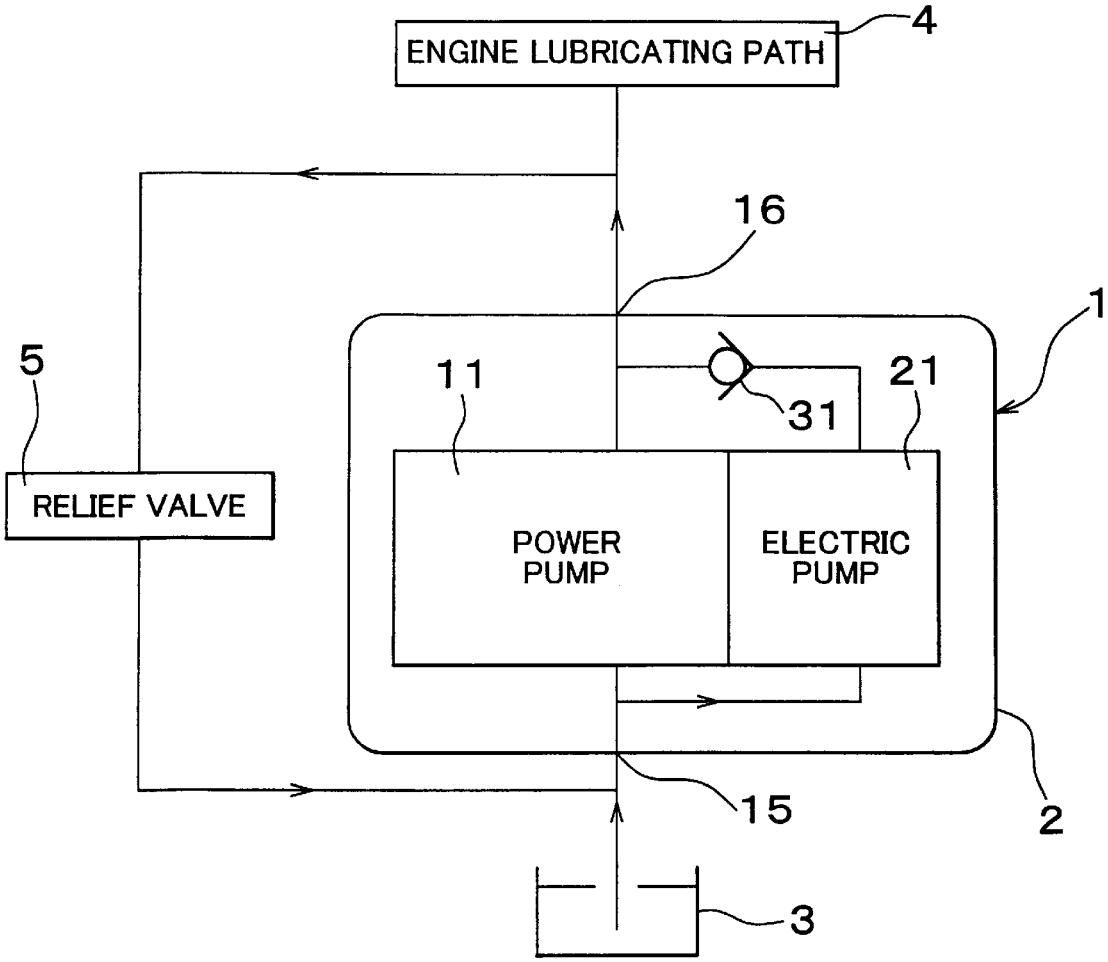
FIG. 2 is a diagram that shows oil flow in a lubricating system for the engine according to the embodiment of the invention.

An oil pump for an internal combustion engine (hereinafter referred to as an engine) is shown in FIGS. 1, 2, 3 and 4. Referring to FIG. 2, oil is pumped up by an oil pump 1 for the engine from an oil pan 3, and is drawn into an intake port 15. The oil is discharged through a discharge port 16 via a power pump 11 or an electric pump 21 so as to be supplied to an engine lubricating path 4. A surplus quantity of the oil supplied from the oil pump 1 under pressure is returned to the oil pan 3 at a low pressure side through a relief valve 5.

Referring to FIG. 1, a pump housing 2 of the oil pump 1 is provided with the intake port 15 and the discharge port 16. The oil pump 1 includes a power pump 11 serving as a first pump that is driven by a driving force of a crankshaft and an electric pump 21 serving as a second pump that is driven by a driving force of an electric motor, both of which are contained in the pump housing 2.

The power pump 11 as the first pump of a trochoid type has a pump shaft 12 that is rotated by and synchronously with a crankshaft of an engine. The pump shaft 12 is provided with a first drive rotor 13 serving as an inner rotor. A first driven rotor 14 as an outer rotor is rotatively supported on an inner wall 7 of the pump housing 2 at an outer side of the first drive rotor 13. In this embodiment, the first drive rotor 13 has four outer teeth formed on its periphery. The first driven rotor 14 has five inner teeth, the number of which is larger than the outer teeth of the first drive rotor 13. Referring to FIG. 1, when the first drive rotor 13 rotates in a direction as shown by the arrow, the inner teeth of the first driven rotor 14 are brought into mesh with the outer teeth of the first drive rotor 13, thus rotating the first driven rotor 14 in the same direction. As a result, the oil flowing into a first pump chamber 17 through the intake port 15 is supplied to the discharge port 16 as the capacity of the pump chamber changes. The oil flowing into the intake port 15 is introduced into a pump chamber defined by the outer teeth of the first drive rotor 13 and the inner teeth of the first driven rotor 14. Then the oil within the pump chamber is supplied to the discharge port 16 as the pump shaft 12 rotates. The oil is finally discharged through the discharge port 16.

The electric pump 21 as the second pump is of the trochoid type, which is the same as the power pump 11 as the first pump, having the intake port 15 that is commonly used by the power pump 11. A second discharge port 25 associated with the electric pump 21 is communicated with the commonly used discharge port 16 through a passage 32, a valve mount 33, and a passage 34. The capacity of the electric pump 21 is smaller than that of the power pump 11 and includes a pump shaft 22 that rotates synchronously with an electric motor shaft (not shown) to which a second drive rotor 23 is attached. A second driven rotor 24 having inner teeth that rotate in mesh with the outer teeth of the second drive rotor 23 is rotatively supported on an inner wall 8 of the pump housing 2. The discharging capacity of the electric pump 21 is set to a predetermined value in accordance with a revolution speed of the electric motor. The second drive rotor 23 is smaller than the first drive rotor 13, and the second driven rotor 24 is smaller than the first driven rotor 14.

A check valve 31 is installed in the valve mount 33 of the pump housing 2. The passage 32 is communicated with an inlet side of the valve mount 33, and the passage 34 is communicated with an outlet side of the valve mount 33. The second discharge port 25 of the electric pump 21 is located at an inlet side of the valve. The passage 34 communicating with the discharge port 16 locates in an outlet side of the valve.

Figure 3:
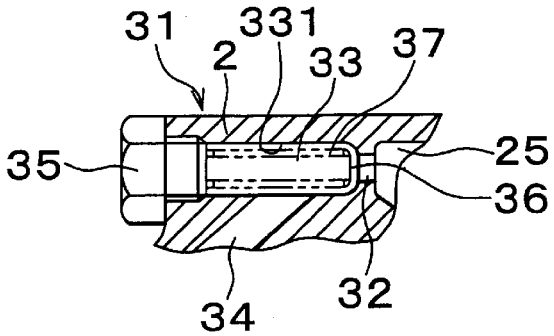
FIG. 3 is a view illustrating a check valve in a closed state for the oil pump for the engine according to the embodiment of the invention.
Figure 4:
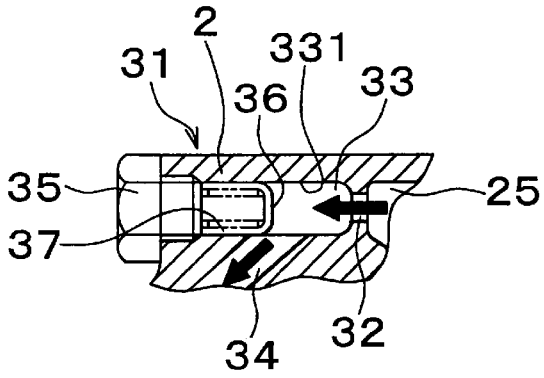
FIG. 4 is a view illustrating the check valve in an open state for the oil pump for the engine according to the embodiment of the invention.

Referring to FIGS. 3 and 4, the check valve 31 will be described in detail. A cylindrical valve element 36 having a bottom is slidably mounted on an inner wall 331 of the valve mount 33 in the pump housing 2. A compression coil spring 37 is set within the valve element 36. The biasing force generated by the compression coil spring 37 causes the valve element 36 to close the passage 32. FIG. 3 is a view illustrating the check valve 31 in a closed state, and FIG. 4 is a view illustrating the check valve 31 in an open state. The valve element 36 is stopped at a position where the pressure difference between the passage 34 and the second discharge port 25 is equilibrated with the biasing pressure of the compression coil spring 37.

When the pressure difference between the passage 34 and the second discharge port 25 increases to cause the valve element 36 to communicate the passage 34 with the valve mount 33, the oil flows in a direction as shown by arrows in FIG. 4. When the driving force of the electric motor is transmitted to the second pump shaft 22, the second drive rotor 23 at a driving side rotates in a direction as shown by arrow in FIG. 1. Then the second driven rotor 24, at a driven side, having inner teeth in mesh with the outer teeth of the second drive rotor 23 is rotated. Accordingly the oil is drawn into the pump chamber defined by the outer teeth and the inner teeth of the rotors 23, 24. The oil is then discharged into the second discharge port 25 from the pump chamber through pumping functions.

Figure 5:
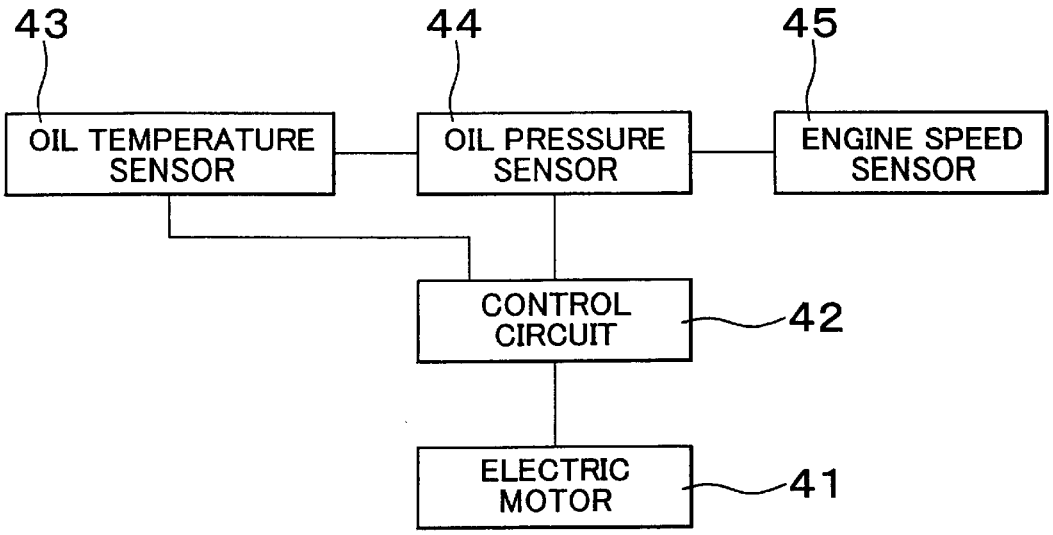
FIG. 5 is a block diagram of a control circuit for an electric motor according to the first embodiment of the invention.

Referring to FIG. 5, the electric pump rotates synchronously with the motor rotating shaft of an electric motor 41 that is driven by a driving signal sent from a control circuit 42. The control circuit 42 receives an oil temperature signal sent from an oil temperature sensor 43, an oil pressure signal sent from an oil pressure sensor 44, and an engine speed signal sent from an engine speed sensor 45 and computes those signals such that the current for driving the electric motor 41 is determined.

When it is detected that the oil supply is insufficient with respect to the oil pressure value that has been preliminarily set in accordance with the revolution speed of the engine mounted in the vehicle, the control circuit 42 increases the rotating speed of the electric motor 41 until the oil pressure becomes a predetermined value. The rotating speed of the electric motor 41 may be kept constant until the oil pressure value becomes the predetermined value. Alternatively the rotating speed of the electric motor 41 may be accelerated.

The electric pump 21 is operated as an auxiliary pump when the discharge pressure of the power pump 11 does not reach a predetermined pressure such that the discharge pressure reaches the target pressure. For example, in case of the high oil temperature and low engine speed, the electric pump 21 is operated together with the power pump 11 so as to generate the hydraulic pressure at which the hydraulic pressure mechanism located downstream of the pump can be controlled. Meanwhile in case of high engine speed, the power pump 11 is operated and the electric pump 21 is stopped.

In the composite oil pump including the power pump and the electric pump, the discharge pressure is set to be kept in a range from 60 to 120 kPa in the state where the oil temperature is equal to or higher than 80° C., and the engine speed is equal to or lower than 2000 rpm. The check valve 31 is provided between the second discharge port 25 of the electric pump 21 and the commonly used discharge port 16 communicated therewith so as to prevent the oil flow from the discharge port 16 to the second discharge port 25.

Figure 6:
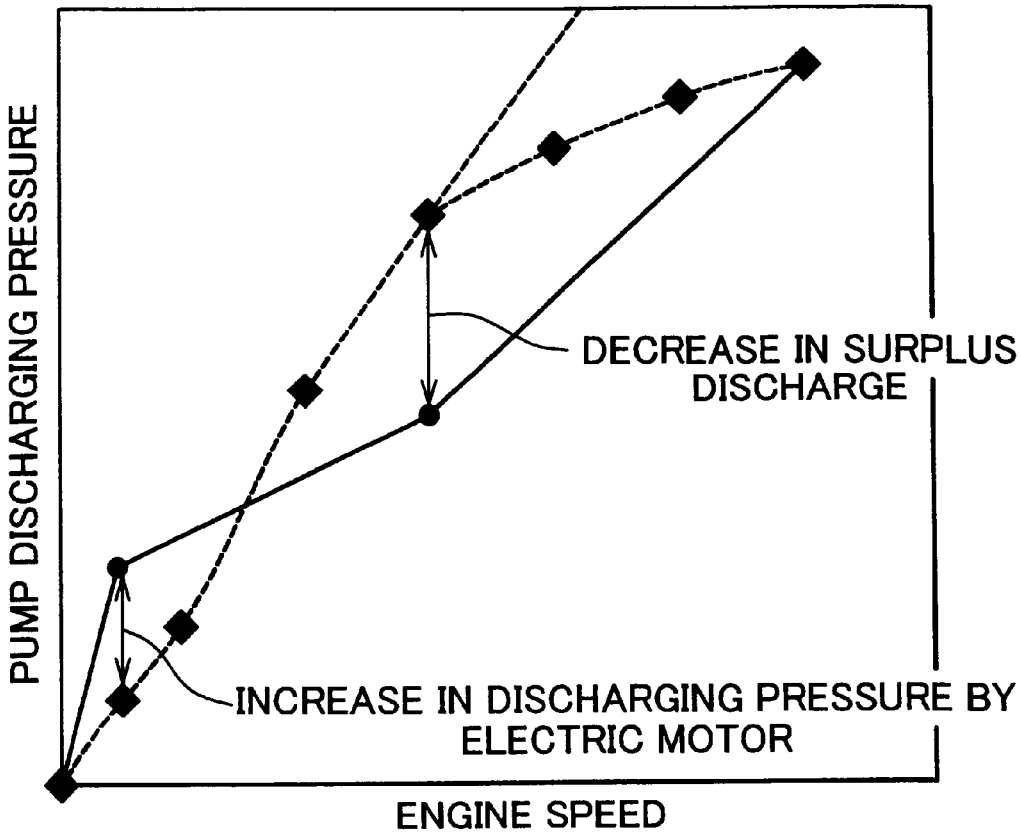
FIG. 6 is a graph representing a relationship between a discharge pressure of the pump and an engine speed according to the embodiment of the invention.

The operation of the oil pump according to an embodiment of the invention will be described. Referring to FIG. 6, when the engine speed is in a low speed vehicle speed range, both the power pump 11 and the electric pump 21 are operated to increase the discharge pressure, supplying sufficient quantity of the oil to the engine lubricating system. When the engine speed is in the vehicle speed range from the medium to high speed, only the power pump 11 is operated and the electric pump 21 is stopped. As a result, the discharge pressure is adjusted to a relatively low pressure, thus reducing the surplus supply of the oil. Accordingly, the oil required for lubrication may be supplied in a lesser quantity by the oil pump, thus preventing unnecessary energy consumption. Now the operation mode of the oil pump for the engine will be described.

1) Mode for Preventing Operation Failure in Engine

In the illustrated embodiment, the control circuit 42 is set such that the electric pump 21 is operated when a total rotating speed of the power pump 21 or a total time period for operating the engine reaches a preset value, and the oil temperature reaches 80° C. or higher. Accordingly the failure in the electric pump 21 owing to adhesion of sludge contained in the oil can be prevented.

2) Mode for Re-Starting the Engine

Upon switching of the ignition key of the engine from ON to OFF, the electric pump 21 is operated for a predetermined period of time. In this case, for example, after changing the engine in an operation state to a stopped state, the electric pump 21 is operated for a predetermined time period. For example, the electric pump 21 is operated for the predetermined time period when the running engine is stopped. In the aforementioned case, the engine can be re-started at a timing when the intake/discharge valve is located at an optimal position. In the aforementioned mode, a hydraulic pressure is generated, under which a vane pump of a continuous variable valve timing mechanism is returned to an arbitrary position. The engine is stopped by bringing the intake valve of the engine into a closed state so as to be kept before restart of the engine.

Another embodiment of the invention will be described referring to FIG. 7. In this embodiment, the power pump rotated by a driving force of the crankshaft is provided apart from the electric pump rotated by the electric motor.

A pump housing 68 containing a power pump 51 is separated from a pump housing 78 containing an electric pump 61. The power pump 51 is located near the crankshaft. Meanwhile, as the electric pump 61 is driven by the electric motor, requiring no driving force of the crankshaft, the position at which the electric pump 61 may be disposed is not limited. Therefore, the electric pump may be disposed at a position apart from the power pump 51.

Figure 7:
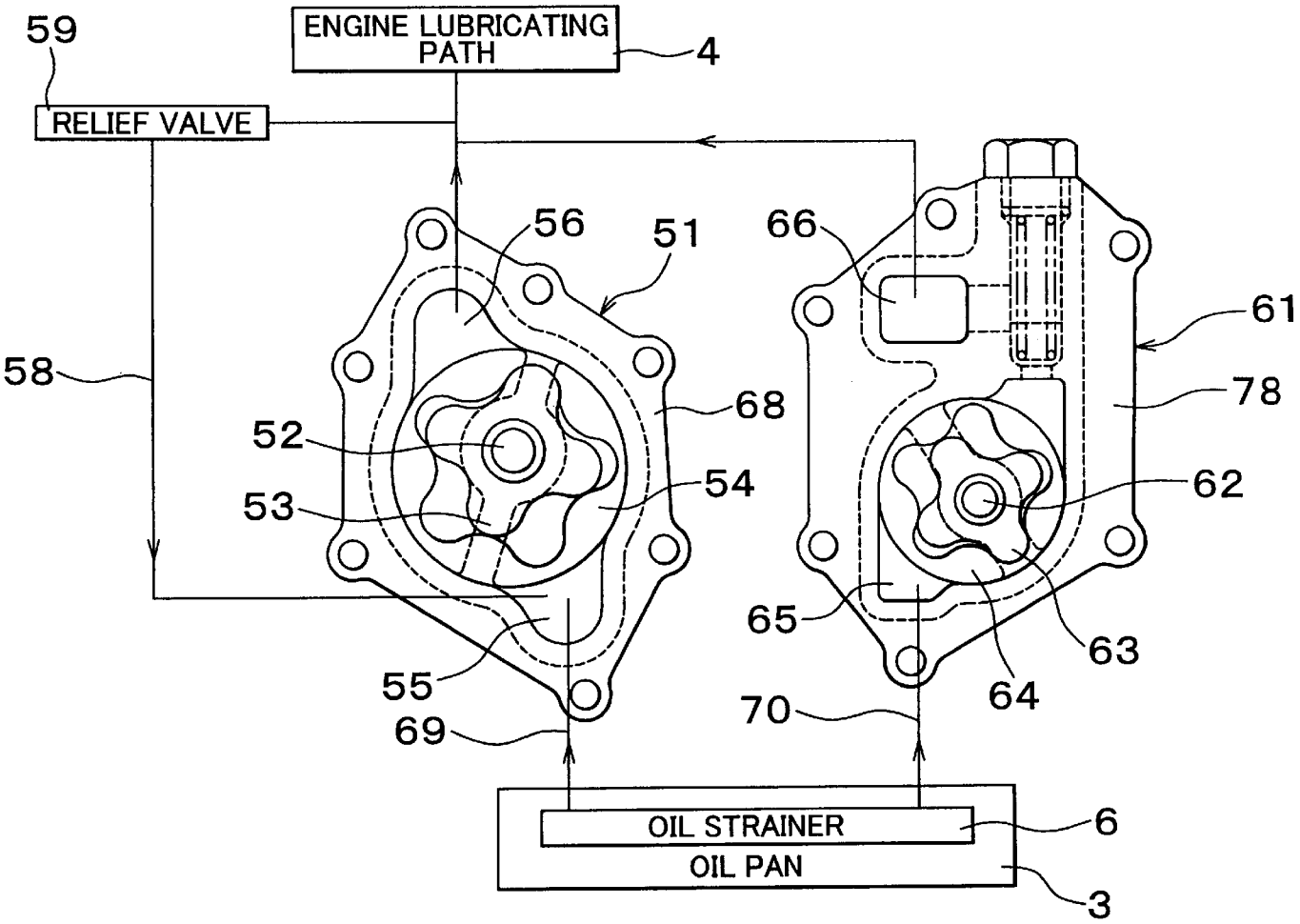
FIG. 7 is a schematic view illustrating an oil pump for an engine according to another embodiment of the invention.

Referring to FIG. 7, a pump shaft 52 is rotated by a driving force of the crankshaft. A first drive rotor 53 is mounted on a pump shaft 52. A first driven rotor 54 is meshed with the first drive rotor 53. The power pump 51 is further provided with an intake port 55 and a discharge port 56. A passage 58 that bypasses the intake port 55 and the discharge port 56 is provided with a relief valve 59.

Meanwhile the electric pump 61 is provided with a second pump shaft 62 rotated by the driving force of the electric motor, a second drive rotor 63 mounted on the second pump shaft 62, a second driven rotor 64 that is meshed with the second drive rotor 63, an intake port 65, and a discharge port 66. Oil supply passages 69, 70 are formed at the inlet ports 55, 65, which communicate with an oil strainer 6 and the oil pan 3. The discharge ports 56, 66 communicate with the engine lubricating path 4.

Figure 8:
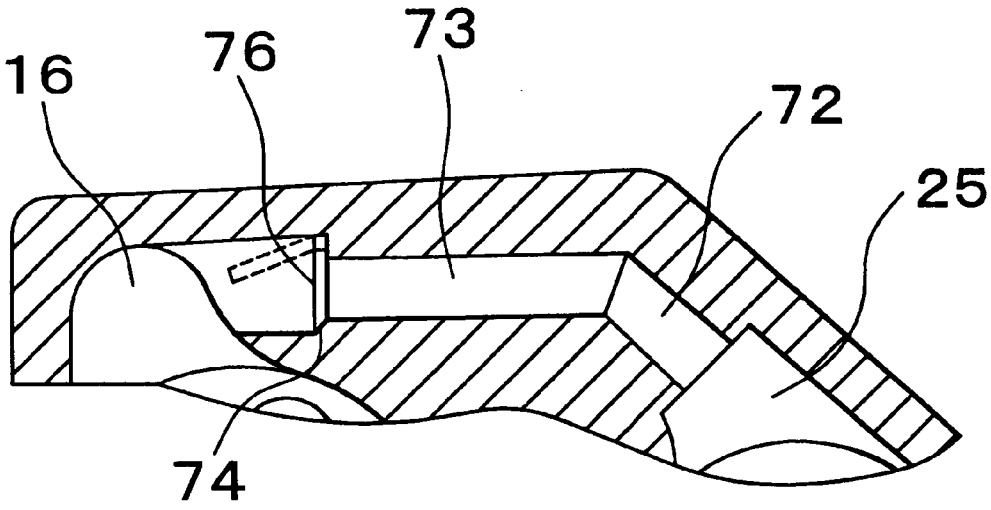
FIG. 8 is a view illustrating a check valve for the oil pump for the engine according to the embodiment of the invention.

Another embodiment having a check valve used in an oil pump will be described referring to FIG. 8. The check valve is opened and closed without using the spring mechanism but in accordance with a difference in the discharge pressure between the power pump and the electric pump.

The second discharge port 25 of the electric pump is connected to the discharge port 16 via passages 72, 73. A valve element 76 provided between the passage 73 and the discharge port 16 may be brought into an abutment against or apart from a convex portion 74 as a valve seat. The valve element 76 may be formed of a material such as a metal, a resin, and a rubber.

In this embodiment, the power pump and the electric pump are operated upon start of the engine. In the low speed range, as the discharge pressure of the power pump rotated by the first pump shaft has not become sufficiently high, the valve element 76 is opened in a direction shown by the dotted line in FIG. 8 so long as the discharge pressure of the electric pump is higher than that of the power pump. As a result, the oil is discharged to the discharge chamber 16 side.

In the medium engine speed range, the discharge pressure of the power pump is increased to discharge sufficient quantity of the oil at the sufficient oil discharge pressure. When the electric pump is stopped, the valve element 76 is pressed against the convex portion 74 as the valve seat by the discharge pressure of the electric pump rotated by the first pump shaft. This may cause the oil passage into a valve closing state, thus preventing the reverse flow of the oil from the discharge port 16 to the electric pump side.

While the invention has been described with reference to what are presently considered to be preferred embodiments thereof, it is to be understood that the invention is not limited to the disclosed embodiments or constructions. Instead, the invention is intended to cover various modifications and equivalent arrangements. In addition, while the various elements of the disclosed invention are shown in various combinations and configurations, which are exemplary, other combinations and configurations, including more or less elements, are also within the spirit and scope of the invention.

What is claimed is:

1. An oil pump for an internal combustion engine, comprising:

a power pump that is rotated by a drive shaft of the internal combustion engine;

an electric pump that is rotated by a driving force of an electric motor, the power pump and the electric pump being arranged in parallel with each other; and a check valve that is disposed in an oil passage for connecting a discharge port of the power pump to a discharge port of the electric pump such that an oil is allowed to flow only in a direction from the electric pump to the power pump, wherein the electric pump is driven when an oil temperature becomes about 80° C. or higher, and a revolution speed of the internal combustion engine becomes at most about 2000 rpm, so that a discharge pressure is held in a range of about 60 to about 120 kPa.

2. The oil pump according to claim 1, wherein the power pump comprises a gear pump.

3. The oil pump according to claim 1, wherein the electric pump comprises a gear pump.

4. The oil pump according to claim 2, wherein the electric pump comprises a gear pump.

5. An oil pump for an internal combustion engine, the oil pump having an intake port and a discharge port, comprising:

a pump housing including a first pump chamber that is formed in a first passage that connects the intake port to the discharge port of the oil pump, and a second pump chamber that is formed in a second passage that bypasses the first passage and connects the intake port to the discharge port;

a power pump that is provided in the first pump chamber and rotated by a driving force of the internal combustion engine;

an electric pump that is provided in the second pump chamber and rotated by a driving force of an electric motor; and a check valve that is provided in the second passage of the pump housing, and opens when a pressure of an oil discharged from the second pump chamber is higher than an oil pressure at the discharge port of the oil pump by a predetermined value or greater.

6. The oil pump according to claim 5, wherein the power pump includes a first driven rotor rotatively mounted on an inner wall of the first pump chamber and having a plurality of inner teeth, a first drive rotor has a plurality of outer teeth in mesh with the inner teeth, and a first pump shaft that is mounted on the first drive rotor and is rotated by a driving force of the internal combustion engine.

7. The oil pump according to claim 5, wherein the electric pump includes a second driven rotor rotatively mounted on the second pump chamber and having a plurality of outer teeth, a second drive rotor having a plurality of outer teeth in mesh with the inner teeth, and a second pump shaft that is mounted on the second drive rotor and is rotated by a driving force of the electric motor.

8. The oil pump according to claim 6, wherein the electric pump includes a second driven rotor rotatively mounted on the second pump chamber and having a plurality of outer teeth, a second drive rotor having a plurality of outer teeth in mesh with the inner teeth, and a second pump shaft that is mounted on the second drive rotor and is rotated by a driving force of the electric motor.

9. The oil pump for an internal combustion engine according to claim 5, therein the electric pump is driven when an oil temperature becomes about 80° C. or higher, and a revolution speed of the internal combustion engine becomes about 2000 rpm or less, so that a discharge pressure is held in a rage of about 60 to about 120 kPa.

10. A method of operating an oil pump for an internal combustion engine that includes:

a) a power pump that is rotated by a drive shaft of the internal combustion engine;

b) an electric pump that is rotated by a driving force of an electric motor, the power pump and the electric pump being arranged in parallel with each other; and c) a check valve that is disposed in an oil passage for connecting a discharge port of the power pump to a discharge port of the electric pump such that an oil is allowed to flow only in a direction from the electric pump to the power pump;

wherein a drive circuit for driving the electric pump is actuated when the internal combustion engine is operated for a predetermined period of time or longer, and an oil temperature reaches about 80° C. or higher.

11. A method of operating an oil pump for an internal combustion engine that includes:

a) a pump housing including a first pump chamber that is formed in a first passage that connects the intake port to the discharge port of the oil pump, and a second pump chamber that is formed in a second passage that bypasses the first passage and connects the intake port to the discharge port;

b) a power pump that is provided in the first pump chamber and rotated by a driving force generated by the internal combustion engine;

c) an electric pump that is provided in the second pump chamber and rotated by a driving force of an electric motor; and d) a check valve that is provided in the second passage of the pump housing, and opens when a pressure of an oil discharged from the second pump chamber is higher than an oil pressure at the discharge port of the oil pump by a predetermined value or greater, wherein a drive circuit for driving the electric pump is actuated when the internal combustion engine is operated for a predetermined period of time or longer, and an oil temperature reaches about 80° C. or higher.

12. A method of operating an oil pump for an internal combustion engine that includes:

a) a pump housing including a first pump chamber that is formed in a first passage that connects the intake port to the discharge port of the oil pump, and a second pump chamber that is formed in a second passage that bypasses the first passage and connects the intake port to the discharge port;

b) a power pump that is provided in the first pump chamber and rotated by a driving force generated by the internal combustion engine;

c) an electric pump that is provided in the second pump chamber and rotated by a driving force of an electric motor; and d) a check valve that is provided in the second passage of the pump housing, and opens when a pressure of an oil discharged from the second pump chamber is higher than an oil pressure at the discharge port of the oil pump by a predetermined value or greater, wherein:

the electric pump is operated for a predetermined time period after turning off an ignition switch of the internal combustion engine.

13. An oil pump for an internal combustion engine, comprising:

a power pump that is rotated by a drive shaft of the internal combustion engine;

an electric pump that is rotated by a driving force of an electric motor, the power pump and the electric pump being arranged in parallel with each other and the electric pump is driven when an oil temperature becomes at least about 80° C.; and a check valve that is disposed in an oil passage for connecting a discharge port of the power pump to a discharge port of the electric pump such that oil is allowed to flow only in a direction from the electric pump to the power pump.

14. The oil pump according to claim 13, wherein the electric pump is driven when a revolution speed of the internal combustion engine becomes at most about 2000 rpm.

15. The oil pump according to claim 13 wherein the electric pump is driven to hold a discharge pressure in a range of about 60 to about 120 kPa.

16. An oil pump for an internal combustion engine, comprising:

a power pump that is rotated by a drive shaft of the internal combustion engine;

an electric pump that is rotated by a driving force of an electric motor, the power pump and the electric pump being arranged in parallel with each other and the electric pump is driven when a revolution speed of the internal combustion engine becomes at most about 2000 rpm; and a check valve that is disposed in an oil passage for connecting a discharge port of the power pump to a discharge port of the electric pump such that oil is allowed to flow only in a direction from the electric pump to the power pump.

17. The oil pump according to claim 16, wherein the electric pump is driven to hold a discharge pressure in a range of about 60 to about 120 kPa.

* * * * *